United States Patent [19]

Portuese

[11] Patent Number: 5,052,087

[45] Date of Patent: Oct. 1, 1991

[54] CHILD PROOF SEAT BELT RESTRAINT

[76] Inventor: Peter G. Portuese, 39 Huron St., Terryville, N.Y. 11776

[21] Appl. No.: 651,511

[22] Filed: Feb. 6, 1991

[51] Int. Cl.[5] ..... A44B 11/26

[52] U.S. Cl. ..... 24/633; 24/573.1

[58] Field of Search ..... 24/633, 634, 632, 635, 24/637, 650, 656, 573.1, 573.5, 636; 297/468; 292/DIG. 2, DIG. 11, DIG. 65

[56] References Cited

U.S. PATENT DOCUMENTS

| | | | |
|---|---|---|---|
| 4,497,094 | 2/1985 | Morris | 24/633 |
| 4,502,194 | 3/1985 | Morris et al. | 24/633 |
| 4,624,033 | 11/1986 | Orton | 24/633 |
| 4,674,303 | 6/1987 | Salcone, II | 24/633 |
| 4,675,954 | 6/1987 | Gullickson | 24/633 |
| 4,731,912 | 3/1988 | Boriskie et al. | 24/633 |
| 4,878,277 | 11/1989 | Portuese | 24/633 |
| 4,961,251 | 10/1990 | Smith | 24/633 |
| 4,987,662 | 1/1991 | Haffey et al. | 24/633 |

FOREIGN PATENT DOCUMENTS

| | | | |
|---|---|---|---|
| 8401275 | 4/1984 | European Pat. Off. | 24/633 |

*Primary Examiner*—Victor N. Sakran
*Attorney, Agent, or Firm*—Terry M. Gernstein

[57] ABSTRACT

A child proof cover for covering and protecting a seat belt buckle assembly includes a channel which provides access to the release control of the seat belt buckle assembly. The channel is sized and configured so that a child cannot reach the release control but an adult can reach the control to operate such control in the manner in which that control was designed to operate. The cover is an integral, one-piece unit and the channel extends forwardly of and at an angle to one end of a lower section thereof. The other end of the lower section is open. The cover is intended to be stored on one of the seat belts when not in use.

12 Claims, 2 Drawing Sheets

CHILD PROOF SEAT BELT RESTRAINT

TECHNICAL FIELD OF THE INVENTION

The present invention relates to the general art of seat belts used in passenger vehicles, and to the particular field of protecting a seat belt operating mechanism, and specifically relates to preventing a child from operating a release control associated with a seat belt assembly.

BACKGROUND OF THE INVENTION

Seat belts have been shown to have great utility in preventing injury to passengers of motor vehicles. Specifically, such seat belts generally accomplish such object by preventing, inter alia, a passenger from moving forward far enough to have his head impact the dashboard or the windshield in an accident.

As is also well documented, children, especially very small and young children, are more susceptible to such head injury causing impact than adults because, in a collision, a child can be launched from a seat in a missile-like fashion toward the windshield without impediment; whereas, an adult at least may have his legs contact the dashboard thereby slowing his velocity toward the impact point.

For this reason, it is extremely important for a child to be securely belted in his seat at all times when a motor vehicle is in operation. Accordingly, there have been several seat belt designs proposed especially for children.

However, a seat belt is of little or no use if the child unbuckles it. Therefore, there have been designs for "child proofing" a seat belt release control. Such child proofing means should balance a need to prevent the child from operating the release control with the need for the belt release to be operable by an adult in a manner which permits the belt to be quickly released in the event of an accident.

Heretofore, some known child proofing means have included a release control actuating means that is too stiff for a child to operate, or a key lock mechanism, or a complicated mechanism to actuate the release.

These known child proofing means have not been entirely successful because, while they may accomplish the object of preventing a child from operating the belt release control, they do so in a manner that may interfere with the designed operation of the belt control itself and thus may not perform the afore-discussed balancing in a most effective manner.

For example, by including a key lock, the easy access to the release control itself may be impaired, or by including means that is too stiff for a child to operate, the designed operation of the control is inhibited.

For this reason, while some known child proofing means have been proposed, automobile manufactures and sellers have been reluctant to include such means in a motor vehicle for fear that the interference with the design considerations of the seat belt release control will have more drawbacks than advantages.

Another reason for the limited acceptance of some of the known child proofing means is that some of these means may be difficult or expensive to manufacture thereby being too expensive to sell to a car buyer.

The present inventor has disclosed, in U.S. Pat. No. 4,878,277 (the disclosure of which is incorporated herein by reference), a cover for a seat belt release mechanism that prevents a child from operating that mechanism. This cover includes a multi-part housing having a finger access channel on the top of that housing. The housing has a bottom hingeably attached to the housing sides. The housing is opened by moving the bottom away from the sides. After the housing is opened, the seat belt release mechanism is located in the housing. The housing is then closed, and access to the seat belt release mechanism can only be obtained by way of the finger access channel. This channel is sized so that an adult can reach the release mechanism but a child cannot reach that mechanism.

While successfully overcoming many of the objections to the designs known prior thereto, even this patented device can be improved. Specifically, the multipart nature of the patented device can have drawbacks in manufacture or use under some conditions. For example, the patented device is separate from the seat belts, and is placed around the release mechanism after the seat belt is coupled. Thus, when the seat belt is not in use, the cover disclosed in the patent may tend to become lost since it may not be attached to the seat belt. If the cover is to remain attached to the seat belt when the belt is not in use, it must be closed about the belt, then opened prior buckling the seat belt, then closed once the belt is buckled up. This process may create so many steps as to discourage use of the seat belt. As has been documented, it is most beneficial to have the seat belt as easy as possible to use to encourage use of seat belts. Adding further complications to seat belt use may not be entirely desirable, even in the case of further ensuring the safety of a seat occupant.

Furthermore, attaching the patented device to a seat belt when that belt is around a child might be difficult. This is especially so if the child is squirming or moving about when the belt is being fastened and the housing is being manipulated about the buckle control mechanism. The adult must take care to ensure that the housing is properly closed so that it will not accidentally open. This situation may add enough complications to the use of the seat belt that, in one case the patented device will not be used, or in another case, the belt itself may not be used. In either case, ease of use is an important consideration in any device intended for use on a seat belt assembly of a motor vehicle. The device should be as easy to use as possible to encourage its use.

Still further, a multipart housing of the patented device may be more difficult to manufacture than a one-piece housing. The manufacturing cost may thereby be higher than is desired.

Still further, the patented means is not amenable to being easily incorporated into a seat belt buckle mechanism whereby the buckle mechanism and the child proofing means can be manufactured as a single integral unit.

It is often desirable for the child proofed seat belt buckle assembly to be located in full view of a motor vehicle operator. Such positioning will permit the driver to check the seat belt to be sure the child has not released or impaired the connection of the assembly. This is especially helpful in those instances when the child has a history of releasing the buckle assembly. Of course, this positioning of the assembly should be such that the driver of the motor vehicle need not divert his attention from his driving for long periods of time in order to check the assembly.

OBJECTS OF THE INVENTION

It is a main object of the present invention is to provide a means for child proofing a release control mechanism of a motor vehicle seat belt assembly which operates in a manner that is effective to prevent a child from actuating the release control yet which does not significantly interfere with the designed operation of that seat belt release control.

It is another object of the present invention is to provide a means for child proofing a release control mechanism of a motor vehicle seat belt assembly which operates in a manner that is effective to prevent a child from actuating the release control yet which does not significantly interfere with the designed operation of that seat belt release control yet is easy to use so as not to discourage its use and to encourage the use of the child-proofed seat belt any time a child is in a seat of a motor vehicle.

It is another object of the present invention to provide a means for child proofing a release control mechanism of a motor vehicle seat belt assembly that provides easy access to the release control mechanism by an adult.

It is another object of the present invention to provide a means for child proofing a release control mechanism of a motor vehicle seat belt assembly that is efficient to manufacture.

It is a specific object of the present invention to improve the child proofing means disclosed in U.S. Pat. No. 4,878,277.

It is another specific object of the present invention to improve the child proofing means disclosed in U.S. Pat. No. 4,878,277 by including a unitary one-piece monolithic housing as the means for preventing access to the seat belt release control mechanism.

It is another specific object of the present invention to improve the child proofing means disclosed in U.S. Pat. No. 4,878,277 by including a housing that can remain attached to a seat belt when that housing is not in use.

It is another specific object of the present invention to improve the child proofing means disclosed in U.S. Pat. No. 4,878,277 by including a housing that can be located in a position that is inaccessible to a child when the means is in use.

It is another specific object of the present invention to improve the child proofing means disclosed in U.S. Pat. No. 4,878,277 by including a housing that can be located in a position that is easily viewed by a motor vehicle operator.

It is another specific object of the present invention to improve the child proofing means disclosed in U.S. Pat. No. 4,878,277 by including a housing that permits easy checking of the coupled status of a seat belt release mechanism located inside that housing.

SUMMARY OF THE INVENTION

These, and other, objects are achieved by improving the seat belt child proofing means disclosed in U.S. Pat. No. 4,878,277 to include an integral, one-piece monolithic housing that can remain attached to a seat belt when that seat belt is not in use, and has means for encasing a seat belt assembly release mechanism in a manner that permits the seat belt buckle mechanism to be located for easy viewing and access by an adult in an adjacent seat yet is not readily accessible to an occupant of the seat belt being child proofed. The housing is amenable to being incorporated directly into the seat belt buckle if suitable, and is translucent whereby the status of the buckle contained therein can be easily viewed.

The improved child proofing means has all of the advantages of the patented device and also can be stored on the seat belt when not in use whereby it is not likely to become lost between uses and can be easily used, and can be located adjacent to a occupied seat whereby the status of the buckle can be monitored. Furthermore, the one-piece nature of the improved device may make manufacturing thereof somewhat more efficient, and also serve to improve the strength and integrity thereof, and the improved device is easier to operate than the patented device.

BRIEF DESCRIPTION OF THE DRAWING FIGURES

DETAILED DESCRIPTION OF THE PREFERRED EMBODIMENT OF THE INVENTION

Figure 1:
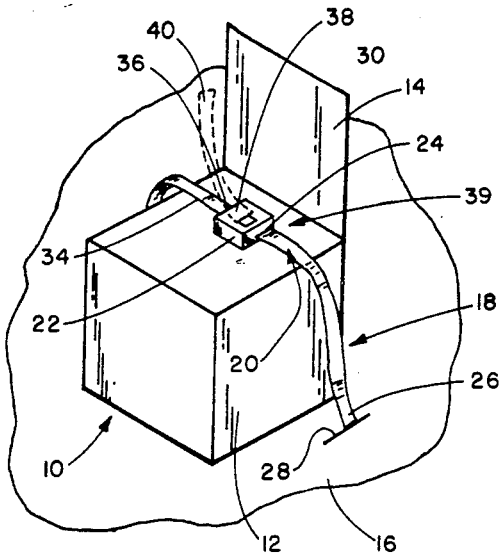
FIG. 1 is a perspective view illustrating a prior art seat belt assembly.

Shown in FIG. 1 is a seat 10 illustrative of the type of seat that is commonly found in motor vehicles, such as passenger cars, or the like. The seat 10 includes a bottom 12 on which an occupant sits, and a back rest 14. The seat is mounted on a vehicle floor 16. Commonly, another seat will be adjacent to the seat 10. A seat belt system 18 includes at least a lap belt 20 having a first buckle element 22 on one end 24 thereof and which is affixed to the frame of the motor vehicle at a second end 26 thereof as indicated at anchoring and mounting element 28. The first buckle element will be referred to as a female element and includes a seat belt release control element 30 thereon. The seat belt system further includes a second belt 34 having a first end (not shown in FIG. 1) affixed to the motor vehicle frame, and a second end 36 having a second buckle element 38 fixed thereto. The second buckle element 38 will be referred to as a male element and is received in the element 22 and locked thereto for use, and the overall buckle assembly 39 includes both the first and the second buckle elements as well as the release mechanism. In one form of the seat belt assembly, a shoulder harness 40 is also included and has one end thereof fixed to the second buckle element and another end thereof fixed to the motor vehicle. The shoulder harness extends across an occupant's shoulders and chest. The male buckle element is releasably attached to the female buckle element to secure the seat belt assembly to an occupant of the seat 10. The release mechanism is operated to release the male element from the female element to free the occupant from the seat 10.

As discussed above, children have been known to operate the seat belt release mechanism and thereby unbuckle themselves when the motor vehicle is operating. To prevent this undesirable result, devices have been proposed to prevent the child from operating the release mechanism. The present invention is embodied in an integral, one-piece monolithic housing 50 shown in FIG. 2. The housing 50 includes means for permitting the housing to remain on the seat belt at all times between uses of the seat belt while also being easy to use. The housing is also translucent whereby the status of the seat belt buckle mechanism can be viewed when the housing is in place.

Figure 3:
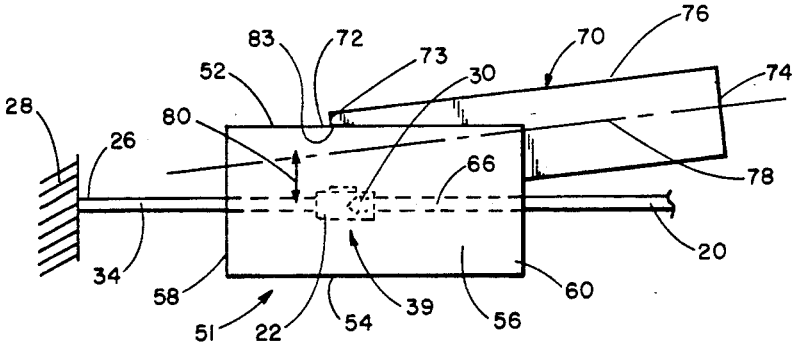
FIG. 3 is a side elevational view of the means embodying the present invention.
Figure 4:
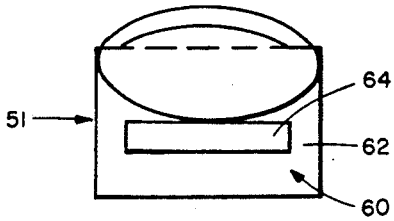
FIG. 4 is an end elevational view thereof as seen from the right side of FIG. 3.
Figure 5:
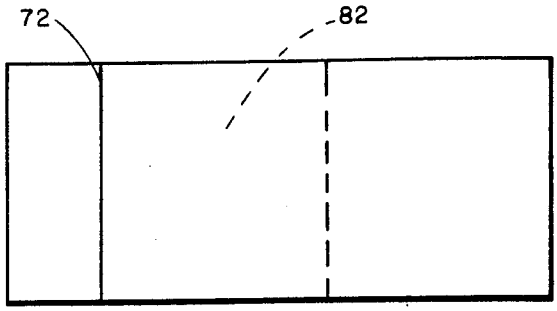
FIG. 5 is a top plan view thereof.

The housing 50 is best shown in FIGS. 3, 4 and 5 and includes a lower section 51 having a top 52, a bottom 54, sides 56, and ends 58 and 60. The housing is hollow, and end 58 is open to provide access to the interior of the housing lower section. The lower section is thus a hollow element having one open end and all other ends and sides closed. End 60 is closed by a wall 62 having an elongated slot 64 defined therein. One of the seat belts 20 or 34 fits through the slot 64 and the shoulder harness 40 can also fit through the slot 64. Either the male or the female element of the buckle assembly 39 can be accommodated in the interior of the housing lower section as is indicated in FIG. 3. Therefore, while the present discussion will refer to maintaining the male element in the housing and maintaining the housing on the male element-attached seat belt while the seat belt is not in use, the disclosure and claims are applicable to a housing located on the female-attached seat belt as well, and no limitation is intended by such discussion.

In one form of the invention, the male element of the buckle assembly is retained in the housing lower section so the housing remains attached to the belt 34. The female element of the buckle assembly 39 is inserted into the interior of the housing lower section via the open end 58 of that housing lower section to be coupled to the male element. The housing can be grasped when the male element is moved to meet the female element during the seat belt buckling process.

Figure 2:
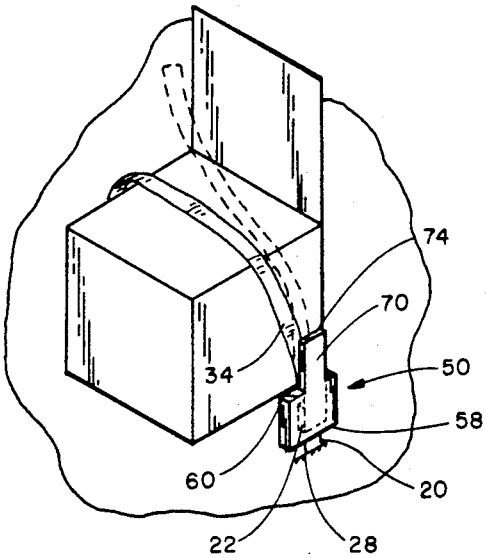
FIG. 2 is a perspective view illustrating the seat belt buckle assembly having a child-proofing means of the present invention thereon.

As shown in FIG. 2, the housing 50 is located next to the floor of the motor vehicle. The open end of the housing lower section is located closely adjacent to that motor vehicle floor. Therefore, the open end 58 is not accessible to a child who is strapped into the seat 10. Accordingly, even though the end 58 is open, the child cannot reach the buckle release mechanism to operate that mechanism. Furthermore, locating the housing 50 adjacent to the floor of the vehicle places that housing in position to be easily viewed by an occupant of a seat adjacent to seat 10. The lower section has a longitudinal centerline 66 that extends between ends 58 and 60.

The housing 50 further includes a finger access channel defining means 70. The channel defining means 70 includes a rear end 72 having a rear wall 73 intersecting the lower section top 52 and extending upward therefrom, a forward end 74 and a hollow oval shaped hollow body 76 connecting end 72 to end 74. The channel defining means intersects the lower section housing top near the open end 58 and extends forwardly of the closed end 60. The channel defining means has a longitudinal centerline 78 that extends between ends 72 and 74 and forms an acute angle 80 with the lower section longitudinal centerline 66. The angle 80 is preferably about 5°. The channel defining means body 76 also intersects the lower section closed end 60 adjacent to the slot 64.

As indicated in FIG. 5, the channel defining means overlaps the housing lower section in an area 82. This area is open so the hollow interior of the housing lower section is connected to the hollow interior of the channel defining means body. Specifically, the open area 82 extends in the top 52 from adjacent to end 60 towards the end 58 and the top includes an edge 83 defining the end of the opening 82. This defines a continuous passage from the channel defining means end 74 to the interior of the housing lower section. The channel defining means rear end 72 is positioned with respect to the housing lower section end 58 so that when the buckle assembly 39 is located inside the housing lower section, the release button 30 is located in area 82 immediately beneath the hollow interior of the channel defining means. This positioning of the channel defining means rear end with respect to the housing lower section end 58 permits the channel defining means to have a length that is sufficient to prevent a child from gaining access to the buckle assembly release button but to be close enough to the forward end of the channel defining means to permit an adult to quickly reach that release button via the channel defining means body. In the preferred form of the housing, the channel defining body has an overall length between the ends 72 and 74 that is about four and one-half inches; whereas the overall length of the housing lower section between ends 58 and 60 is about three and one-half inches, with the end 72 being located about one and one-quarter inches from housing lower section end 58. This spaces the channel defining means rear end 72 from the housing lower section end 58 by a distance that is approximately equal to between one-third and one-half of the total length of housing lower section and has the overall length of the channel defining means by one-fourth of the total length of the housing lower section. The forward end of the channel defining means is spaced from the housing lower section end 60 by a distance about equal to three-fourths of the overall length of the housing lower section.

The forward location of the channel defining means end 74 with respect to the housing lower section end 60 cooperates with the angled orientation of the channel defining means with respect to the housing lower section to permit the housing to be located close to the motor vehicle floor and yet have the seat belts 34 and 40 oriented at angles that are proper for securely and comfortably holding a passenger in seat 10. The ability of the housing to be located closely adjacent to the floor permits the rear end 58 of the housing to be open whereby the housing can be stored on one of the belts 20 or 34 and the other belt quickly and easily inserted into the buckle element on the belt on which the housing is located via that open end. The open nature of housing lower section 58 also permits the housing 50 to be integral and one piece so the housing can be efficiently manufactured. The forward extension of the finger access channel with respect to the housing lower section locates the open end 74 of that channel in a location that provides ready access to an adult riding in a seat adjacent to seat 10. The angled nature of the channel also locates the open end 74 thereof towards the adjacent seat.

Figure 6:
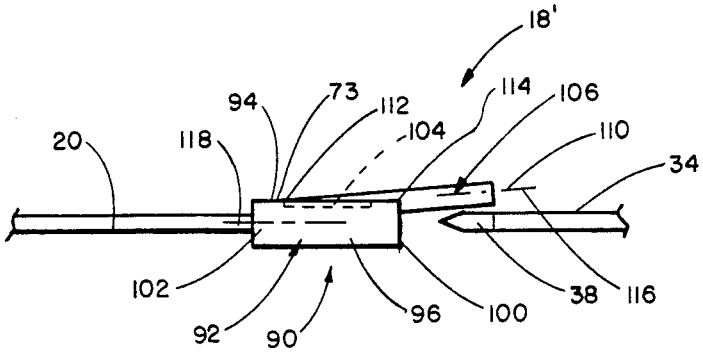
FIG. 6 is a side elevational view of a seat belt buckle having a child-proofing means integral with one element thereof.

Shown in FIG. 6 is a seat belt assembly 18′ that includes a seat belt 20 and a seat belt 34, with the belt 34 having a male buckle element 38 thereon. The belt 20 has a female buckle element 90 on one end thereof. The buckle element 90 includes a housing 92 having a top 94, a bottom 96, sides 98 and ends 100 and 1O2. The belt 20 is coupled to housing end 102, and housing end 100 has a slot into which the male element of the buckle assembly is received to couple the belts 20 and 34 together. A release button 104 is located on the housing top 94. The housing 92 further includes a finger access channel defining means 106 integral therewith. The finger access channel defining means 106 is similar in all respects to finger access channel defining means 70 except that the channel defining means 106 is integral with the buckle assembly female element whereas the channel defining means 70 is integral and one-piece with the housing 50. Thus, the channel defining means 106 includes ends 110 and 112 connected together by a tubular body 114 having a longitudinal centerline 116 extending between ends 110 and 112. The buckle housing also has a longitudinal centerline 118 extending between ends 100 and 102, and the two longitudinal centerlines 116 and 118 are oriented at an acute angle, preferably 5°, with respect to each other. The channel defining means 106 overlaps the housing 92 and opens into the interior of that housing at a location to position the release button 104 in the hollow interior of the channel defining means 106. Access to the release button 104 is via the access channel 106. As before, the channel 106 is dimensioned to facilitate access to the release button 104 by an adult, but to prevent a child from reaching that release button. The relative dimensions placement of the channel defining member 106 and the parts thereof with respect to the housing 92 and the parts thereof are the same as the relative dimensions and placement of channel defining member 70 and the parts thereof with respect to the lower housing section 70 and the parts thereof as discussed above.

Figure 8:
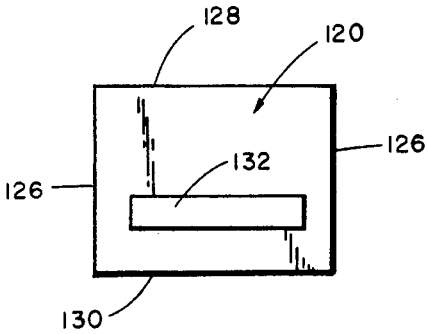
FIG. 8 is an end elevational view of the end cap shown in side elevation in FIG. 7.
Figure 7:
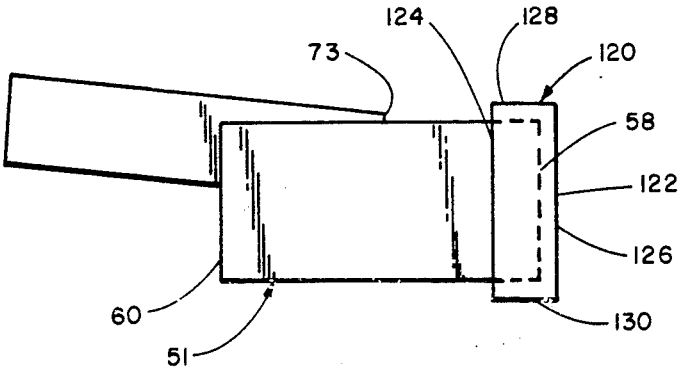
FIG. 7 is a side elevational view of an alternative form of the means of the present invention in which an end cap is used to close an open end of the one-piece housing.

Shown in FIGS. 7 and 8 is a further alternative form of the invention in which an integral, one-piece monolithic end cap 120 is placed over open end 58 of the housing lower section. The end cap 120 includes a closed end 122, an open end 124, sides 126, a top 128 and a bottom 130 and is sized so the top, bottom and sides form a friction fit with the top, bottom and sides of the housing lower section. The end cap also includes an elongated slot 132 defined therethrough. The belt 34 extends through slot 132. The cap 120 remains fixed to the belt 34 and the housing 50 remains fixed to the belt 20 when the buckle is not coupled. This form of the invention permits the housing to be closed. The closing of the housing permits the housing to be located nearer to the FIG. 1 position of the buckle assembly than to the FIG. 2 position thereof. This facilitates further adjustment features of the overall seat belt system.

It is understood that while certain forms of the present invention have been illustrated and described herein, it is not to be limited to the specific forms or arrangements of parts described and shown.

I claim:

1. A child proof cover for preventing a child from releasing a seat buckle assembly, the seat buckle assembly including a first buckle element having a release control and which is operatively attached to one seat belt and a second buckle element which is operatively attached to another seat belt and which is adapted to be releasably coupled to the first buckle element to securely hold a child in place in a motor vehicle seat, the cover comprising:

an integral, one-piece monolithic housing into which both a first buckle element having a release control thereon and a second buckle element releasably coupled to the first buckle element are housed to prevent access to the release control by a child, said housing including (1) a lower section having first and second ends, two sides, a top and a bottom, a slot defined in said first end, said second end being open so one of said first and second buckle elements can slide into and out of said lower section via said second end, and a longitudinal centerline extending between said first and second ends, said lower section having an opening defined in said top and extending from adjacent to said first end toward said second, said top having an opening defining edge extending from one side to another side, said lower housing section having a length dimension measured along said lower housing section longitudinal centerline, (2) a finger access channel defining means on said housing lower section top, said channel defining means including a forward end, a rear end and a hollow body connecting said channel defining means forward and rear ends together, said body having a longitudinal centerline extending between said body forward and rear ends, said channel defining means rear end being located immediately adjacent to said lower section opening defining edge, said opening defining edge being spaced from said lower section open end, said channel defining means longitudinal centerline forming an acute angle with said lower section longitudinal centerline, said finger access channel defining means having a length dimension measured along said channel defining means longitudinal centerline, said channel defining means rear end being located adjacent to said lower housing section second end, said channel defining means body extending above said lower section top surface and intersecting said lower section first end adjacent to said slot and extending forwardly of said lower section first end to have said channel defining means forward end spaced forwardly of said lower section first end, said channel defining means body terminating adjacent to said lower section opening defining edge and having the interior of said hollow body intersecting the interior of said hollow lower section to define a passage from said body forward end into said lower section body.

2. The child proof cover defined in claim 1 wherein said channel defining means body is oval in cross sectional shape.

3. The child proof cover defined in claim 2 wherein said acute angle is 5°.

4. The child proof cover defined in claim 3 wherein said channel defining means rear end is spaced from said lower section second end by between one-third and one half of the total length of said lower section housing.

5. The child proof cover defined in claim 4 wherein said channel defining means length dimension exceeds said lower section length dimension.

6. The child proof cover defined in claim 5 wherein said channel defining means length dimension exceeds said lower section length dimension by one-fourth of said lower section length dimension.

7. The child proof cover defined in claim 6 wherein said channel defining means extends forwardly beyond said lower section first end by one-half to three-fourths the total length of said lower section housing.

8. The child proof cover defined in claim 3 wherein said channel defining means further includes a rear wall on said channel defining means rear end, said rear wall intersecting said lower section top and extending upwardly from said lower section top.

9. The child proof cover defined in claim 1 further including an end cap that is sized to frictionally engage said lower section adjacent to said lower section second end, said end cap including a slot defined through one wall thereof.

10. The child proof cover defined in claim 1 wherein said channel defining means forward end is spaced at least two inches in front of said lower section first end.

11. The child proof cover defined in claim 10 wherein said channel defining means rear end is spaced at least two inches in front of said lower section first end.

12. A means for preventing a child from releasing a seat belt buckle assembly comprising a first buckle element having an integral housing that includes a lower section having first and second ends, two sides, a top and a bottom, a slot defined in said first end through which a male element on another seat belt is received to lock said another seat belt to said first buckle element, a longitudinal centerline extending between said first and second ends, said lower section having an opening defined in said top through which a seat belt buckle release button extends, said top having an opening defining edge extending from one side to another side, said lower housing section having a length dimension measured along said lower housing section longitudinal centerline, a finger access channel defining means on said housing lower section top, said channel defining means including a forward end, a rear end and a hollow body connecting said channel defining means forward and rear ends together, said body having a longitudinal centerline extending between said body forward and rear ends, said channel defining means rear end being located immediately adjacent to said lower section opening defining edge, said opening defining edge being spaced from said lower section open end, said channel defining means longitudinal centerline forming an acute angle with said lower section longitudinal centerline, said finger access channel defining means having a length dimension measured along said channel defining means longitudinal centerline, said channel defining means rear end being located adjacent to said lower housing section second end, said channel defining means body extending above said lower section top surface and intersecting said lower section first end adjacent to said slot and extending forwardly of said lower section first end to have said channel defining means forward end spaced forwardly of said lower section first end, said channel defining means body terminating adjacent to said lower section opening defining edge and having the interior of said hollow body intersecting the top of said lower section to define a passage from said body forward end to said release button.

* * * * *